US009631621B2

(12) United States Patent
Yamaguchi

(10) Patent No.: US 9,631,621 B2
(45) Date of Patent: Apr. 25, 2017

(54) COMPRESSOR

(75) Inventor: Kazuyuki Yamaguchi, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 107 days.

(21) Appl. No.: 14/344,228

(22) PCT Filed: Sep. 3, 2012

(86) PCT No.: PCT/JP2012/072337
§ 371 (c)(1),
(2), (4) Date: Mar. 11, 2014

(87) PCT Pub. No.: WO2013/042527
PCT Pub. Date: Mar. 28, 2013

(65) Prior Publication Data

US 2014/0369880 A1 Dec. 18, 2014

(30) Foreign Application Priority Data

Sep. 21, 2011 (JP) ..... 2011-206044

(51) Int. Cl.
*F01C 21/18* (2006.01)
*F04C 15/06* (2006.01)
(Continued)

(52) U.S. Cl.
CPC ..... *F04C 18/44* (2013.01); *F01C 21/0809* (2013.01); *F04C 18/46* (2013.01); *F04C 23/001* (2013.01); *F04C 27/00* (2013.01)

(58) Field of Classification Search
CPC ..... F01C 21/0809; F01C 21/08; F04C 18/44; F04C 18/46; F04C 27/00
(Continued)

(56) References Cited

U.S. PATENT DOCUMENTS 1,000,316 A * 8/1911 Alexander ..... F04C 2/44 418/172
2,435,476 A * 2/1948 Summers ..... F02B 53/00 123/236
(Continued)

FOREIGN PATENT DOCUMENTS

DE 10 2004 002 151 B3 9/2005
JP 54-69812 A 6/1979
(Continued)

OTHER PUBLICATIONS

International Preliminary Report on Patentability dated Mar. 25, 2014 from the International Searching Authority in counterpart application No. PCT/JP2012/072337.
(Continued)

*Primary Examiner* — Deming Wan
(74) *Attorney, Agent, or Firm* — Sughrue Mion, PLLC

(57) ABSTRACT

A compressor includes a drive shaft, a housing, an annular rotor, and cradles. The rotor has cradle windows. The rotor can rotate within the rotor chamber together with the drive shaft while being in sliding contact with the housing at the circumferential surface. The cradles are provided in the cradle windows to be pivotable about pivot axes. When pivoting, the cradles maintain the compression chambers in an airtight state by being in contact with the housing at pivoting ends of the cradles, the pivoting ends extending along the direction parallel to the axis. The rotor chamber includes an outer operation chamber located on the outside of the rotor, and an inner operation chamber located on the inside of the rotor. The cradles, and the outer operation chamber and/or the inner operation chamber form the compression chambers, the volumes of which are varied by the rotation of the rotor.

16 Claims, 9 Drawing Sheets

(51) Int. Cl.

| | |
|---|---|
| ***F01C 1/44*** | (2006.01) |
| ***F04C 18/336*** | (2006.01) |
| ***F04C 18/44*** | (2006.01) |
| ***F01C 21/08*** | (2006.01) |
| ***F04C 18/46*** | (2006.01) |
| ***F04C 23/00*** | (2006.01) |
| ***F04C 27/00*** | (2006.01) |

(58) Field of Classification Search
USPC ..... 418/186, 266–268, 187, 188
See application file for complete search history.

(56) References Cited

U.S. PATENT DOCUMENTS

| | | | | |
|---|---|---|---|---|
| 2,738,775 | A * | 3/1956 | Smyser | G01F 3/06 418/125 |
| 3,083,894 | A * | 4/1963 | Luck | F02B 53/00 418/150 |
| 5,328,337 | A | 7/1994 | Kunta | |
| 6,354,262 | B2 * | 3/2002 | Wade | F01C 1/44 123/236 |

FOREIGN PATENT DOCUMENTS

| | | | |
|---|---|---|---|
| JP | 59-041602 | A | 3/1984 |
| JP | 60-111077 | A | 6/1985 |
| JP | 61-160292 | U | 10/1986 |
| JP | 01-100394 | A | 4/1989 |
| JP | 01-155091 | A | 6/1989 |
| JP | 5-509371 | A | 12/1993 |
| JP | 09-068171 | A | 3/1997 |
| JP | 10-274050 | A | 10/1998 |
| JP | 2006-336583 | A | 12/2006 |
| JP | 2010-163976 | A | 7/2010 |
| JP | 2011-064189 | A | 3/2011 |
| JP | 2011-122572 | A | 6/2011 |
| WO | 92/03636 | A1 | 3/1992 |

OTHER PUBLICATIONS

International Search Report of PCT/JP2012/072337 dated Nov. 6, 2012.

* cited by examiner

COMPRESSOR

CROSS REFERENCE TO RELATED APPLICATIONS

This application is a National Stage of International Application No. PCT/JP2012/072337 filed Sep. 3, 2012, claiming priority based on Japanese Patent Application No. 2011-206044, filed Sep. 21, 2011, the contents of all of which are incorporated herein by reference in their entirety.

FIELD OF THE INVENTION

The present invention relates to a compressor.

BACKGROUND OF THE INVENTION

As conventional positive displacement compressors, in which the volume of a compression chamber is changed by rotation of a drive shaft, a swash plate compressor, a vane compressor, and a scroll compressor have been known. In a swash plate compressor, pistons are reciprocated at a stroke corresponding to the inclination angle of the swash plate. For example, refer to Patent Document 1. In a vane compressor, vanes protrude from and retract into a rotor while sliding along the inner circumferential surface of the housing. For example, refer to Patent Document 2. In a scroll compressor, a movable scroll orbits about a fixed scroll. Refer, for example, to Patent Document 3.

In these types of positive displacement compressors, the compression chamber draws in fluid through a suction port when the volume of the compression chamber is increased and discharges the fluid through a discharge port when the volume is reduced. Such positive displacement compressors can be employed, for example, for vehicle air conditioners.

In addition, Patent Documents 4 and 5 disclose vane compressors that have compression chambers located at radially outer positions and compression chambers located at radially inner positions. Since the radially inner compression chambers can be provided inside a rotor in these vane compressors, the displacement in relation to the entire volume can be increased.

PRIOR ART DOCUMENTS

Patent Documents

Patent Document 1: Japanese Laid-Open Patent Publication No. 2011-122572

Patent Document 2: Japanese Laid-Open Patent Publication No. 2010-163976

Patent Document 3: Japanese Laid-Open Patent Publication No. 2011-64189

Patent Document 4: Japanese Laid-Open Patent Publication No. 59-41602

Patent Document 5: Japanese Laid-Open Patent Publication No. 1-155091

SUMMARY OF THE INVENTION

Conventional positive displacement compressors have various problems. For example, regarding swash plate compressors, since rotation of the drive shaft is converted into reciprocation of the pistons, vibration tends to be generated. The swash plate compressors also tend to have a great number of components. In this regard, vane compressors and scroll compressors change the volume of compression chambers through rotation of the rotor or the movable scroll, so that the problems of the swash plate compressors are not usually present.

However, in a typical vane compressor, the rotor occupies a large space, and the displacement in relation to the volume of the entire compressor is relatively small. Although the vane compressors disclosed in Patent Documents 4, 5 overcome the problem of relatively small displacement, the vanes receive a great load due to frictional force acting on both ends. This may result in breakage or deformation of the vanes.

In scroll compressors, machining of the volute groove in the fixed scroll is difficult. Further, since the fixed scroll has a complex shape, the strength is hard to be ensured. Thus, when extending the axial measurement to increase the displacement, the thickness of the fixed scroll needs to be increased along the entire volute. This increases the size and weight.

Accordingly, it is an objective of the present invention to provide a novel positive displacement compressor that solves various problems of conventional positive displacement compressors.

To achieve the foregoing objective and in accordance with one aspect of the present invention, a compressor that includes a drive shaft, a housing, an annular rotor, and a cradle is provided. The drive shaft is rotational about a shaft axis. The housing rotationally supports the drive shaft and has a rotor chamber. The rotor chamber is annular and is parallel with the shaft axis. The annular rotor is located in the rotor chamber. The annular rotor has a cradle window radially extending there through and a circumferential surface extending in a direction parallel with the shaft axis. The rotor is rotational together with the drive shaft while sliding on the housing at the circumferential surface. The cradle is provided in the cradle window to be allowed to pivot about a pivot axis parallel with the shaft axis. The cradle slides on the housing at pivoting ends, which extend in directions parallel with the shaft axis, as the rotor rotates. The rotor chamber includes an outer operation chamber located radially outside of the rotor and an inner operation chamber located radially inside of the rotor. The cradle and at least one of the outer operation chamber and the inner operation chamber form a compression chamber, which is caused to change its volume by rotation of the rotor, while maintaining the airtightness. The housing includes a suction port and a discharge port, which communicate with the compression chamber.

According to the compressor according to the present invention, the drive shaft supported by the housing rotates about the shaft axis to cause the rotor to rotate together with the drive shaft in the rotor chamber. Accordingly, the cradle pivots about a pivot axis, which extends in parallel with the shaft axis in the cradle window of the rotor, while rotating in synchronization with the rotor. The rotor chamber includes the outer operation chamber and the inner operation chamber, and the cradle and at least one of the outer operation chamber and the inner operation chamber form the compression chamber. As the rotor rotates, the cradle slides along the housing at the pivoting ends, which extend in parallel with the shaft axis. The compression chamber is caused to change its volume by rotation of the rotor, while maintaining the airtightness. Therefore, the compression chamber draws in fluid through the suction port when its volume is increased and discharges the fluid through the discharge port when the volume is reduced. The compressor is employed, for example, for a vehicle air conditioner.

Since the volume of the compression chamber is changed through rotation of the rotor, vibration is unlikely to be generated in the compressor. In addition, the compressor does not require a large number of components. Further, the rotor of the compressor has an annular shape, and the inner operation chamber is provided radially inside of the rotor. Thus, the compressor has a large displacement compared to typical vane compressors. In addition, because of the shape, the cradle is more resistant to load due to friction and less likely to be broken than vanes.

Further, unlike scroll compressors, the compressor of the invention requires no machining of volute grooves. The compressor does not require any parts having a significantly complicated shape. Thus, even when extending the axial measurement to increase the displacement, the displacement can be increased simply by changing the thickness of the housing, the rotor, and the cradle. This allows the size and the weight to be easily reduced.

As described above, the present invention provides a novel positive displacement compressor, which solves various problems present in conventional positive displacement compressors.

DETAILED DESCRIPTION OF THE PREFERRED EMBODIMENTS

Compressors according to first to third embodiments of the present invention will now be described with reference to the drawings.

First Embodiment

Figure 1:
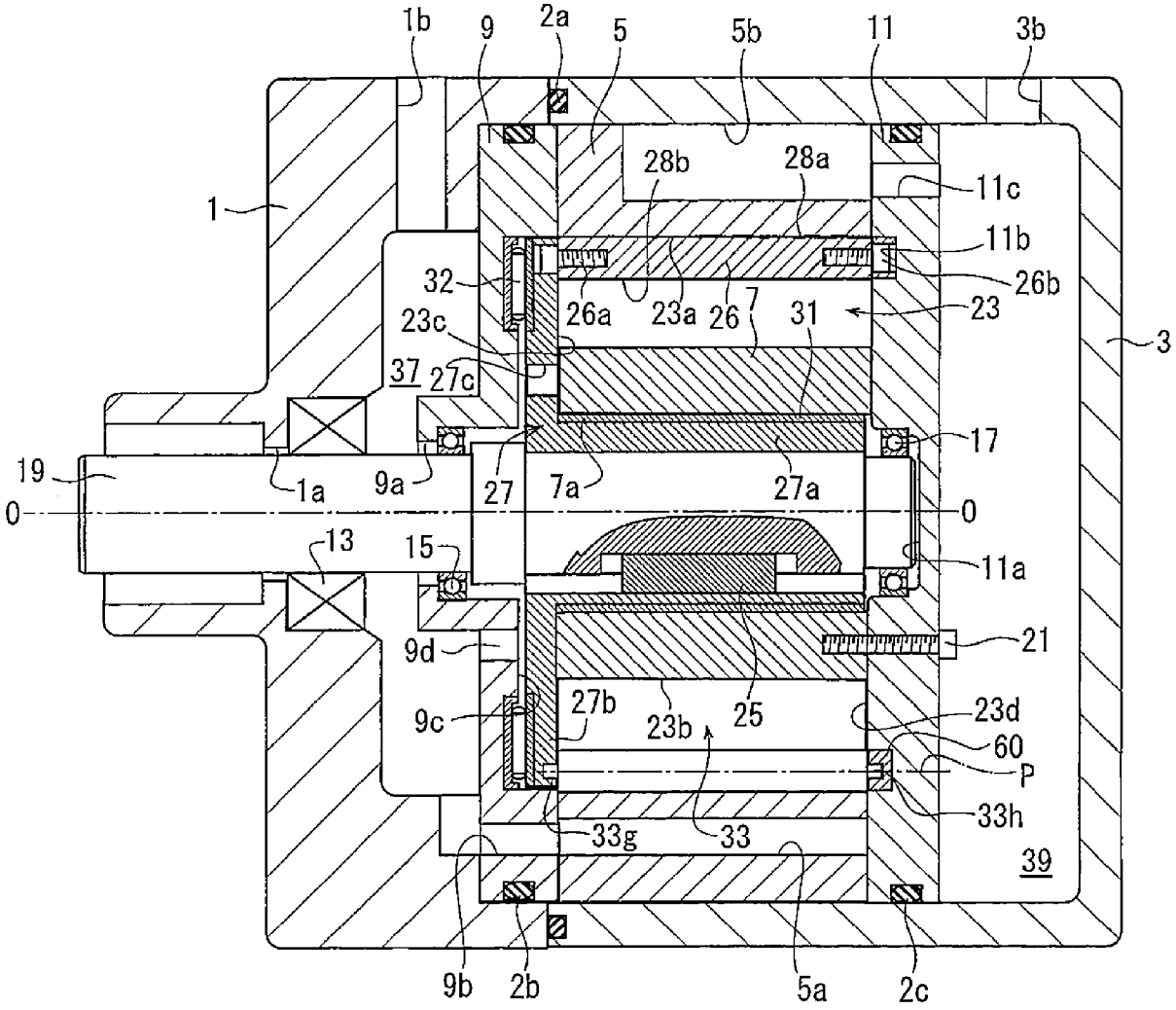
FIG. 1 is an axially cross-sectional view taken along line I-I of FIG. 3, illustrating a compressor according to a first embodiment of the present invention.
Figure 2:
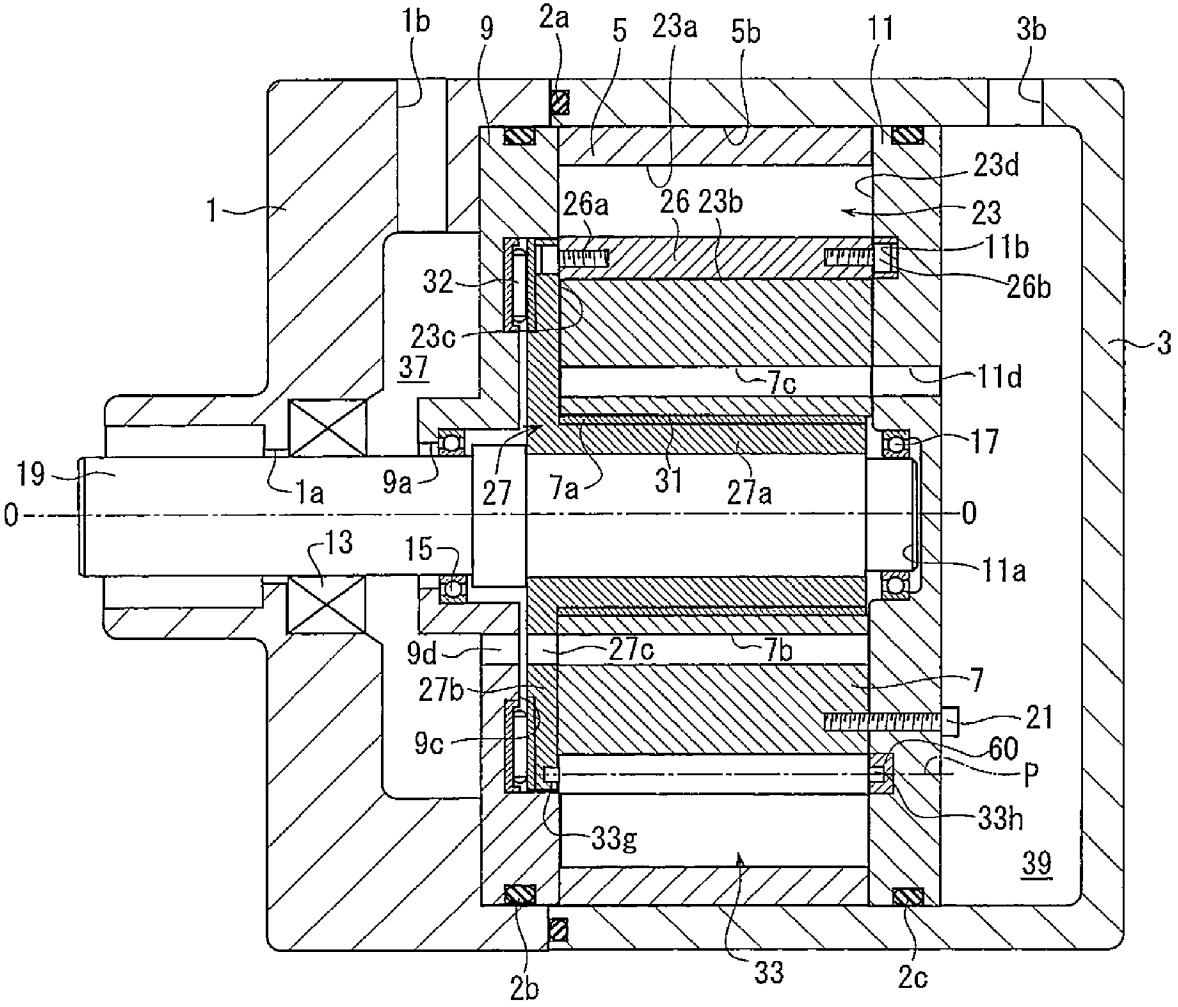
FIG. 2 is an axially cross-sectional view taken along line II-II of FIG. 3, illustrating the compressor according to the first embodiment.

A compressor according to a first embodiment includes a front housing member 1 and a shell 3, which are joined to each other with an O-ring 2*a* in between as shown in FIGS. 1 and 2. An outer block 5, an inner block 7, a front plate 9, and a rear plate 11 are fixed inside the front housing member 1 and the shell 3. The front housing member 1, the shell 3, the outer block 5, the inner block 7, the front plate 9, and the rear plate 11 function as a housing. In FIGS. 1 and 2, the left end is defined as a front side, and the right end is defined as a rear side.

The front housing member 1 has a shaft hole 1*a*, which extends along a shaft axis O and through the front housing member 1. The front plate 9 has a shaft hole 9*a*, which is coaxial with the shaft hole 1*a* and extends through the front plate 9. The rear plate 11 has a bearing recess 11*a*, which is coaxial with the shaft holes 1*a* and 9*a*. A shaft sealing device 13 is located in the shaft hole 1*a*, and a bearing device 15 is located in the shaft hole 9*a*. A bearing device 17 is located in the bearing recess 11*a*. The shaft sealing device 13 and the bearing devices 15, 17 support a drive shaft 19 such that the drive shaft 19 can rotate about the shaft axis O.

The front plate 9 is fixed in the front housing member 1 via an O-ring 2*b*. The rear plate 11 is fixed in the shell 3 via an O-ring 2*c*. The outer block 5 is held between the front plate 9 and the rear plate 11 in the shell 3. The outer block 5 and the inner block 7 have annular shapes as shown in FIGS. 3 to 6. The inner block 7 is arranged in the outer block 5. As shown in FIGS. 1 and 2, the inner block 7 is fixed to the rear plate 11 by bolts 21. A rotor driving recess 9*c* is provided in a center area of the front plate 9. The rotor driving recess 9*c* accommodates a hub 27*b* of a coupling member 27, which will be discussed below. The outer block 5, the inner block 7, the rear plate 11, and the hub 27*b* define an annular rotor chamber 23, which is parallel with the shaft axis O.

The rotor chamber 23 is defined by a rotor chamber inward surface 23*a*, which is parallel with the shaft axis O, a rotor chamber outward surface 23*b*, which is parallel with the shaft axis O, a rotor chamber front end surface 23*c*, which is perpendicular to the shaft axis O, and a rotor chamber rear end surface 23*d*, which is perpendicular to the shaft axis O. The rotor chamber inward surface 23*a* is formed by an inner circumferential surface of the outer block 5. The rotor chamber inward surface 23*a* is designed based on the shaft axis O and pivot axes P of cradles 33, which will be discussed below, and the paths of outer contact surfaces 33*b* in a simulation of rotation of a rotor 26. The rotor chamber outward surface 23*b* is formed by the outer circumferential surface of the inner block 7. The rotor chamber outward surface 23*b* is designed based on the shaft axis O and the pivot axes P of the cradles 33 and the paths of inner contact surfaces 33*c* in a simulation of rotation of the rotor 26. The rotor chamber front end surface 23*c* is formed by the rear surface of the peripheral region of the front plate 9 and the rear surface of the hub 27*b*. The rotor chamber rear end surface 23*d* is formed by the front surface of the rear plate 11.

The inner block 7 has a shaft hole 7*a*, which extends along the shaft axis O and is coaxial with the shaft holes 1*a*, 9*a*. The drive shaft 19 is received by the shaft hole 7*a*. A ring 27*a* of the coupling member 27 is fixed to the drive shaft 19 with a key 25. The coupling member 27 includes the ring 27*a*, which has a cylindrical shape extending in parallel with the shaft axis O, and the hub 27*b*, which extends from the front end of the ring 27*a* in a radial direction perpendicular to the shaft axis O. A plain bearing 31 is provided between the ring 27*a* and the shaft hole 7*a* of the inner block 7.

The rotor 26 is located outside the ring 27*a* of the coupling member 27 and is coaxial with the ring 27*a*. The rotor 26 has a cylindrical shape extending parallel with the shaft axis O. The hub 27*b* of the coupling member 27 is fixed to the front end face of the rotor 26 with bolts 26*a*. The rear end face of the hub 27*b* serves as the rotor chamber front end surface 23*c*, which is flush with the front surface of the outer block 5 and the front surface of the inner block 7. A slider 60 is fixed to the rear end face of the rotor 26 with bolts 26*b*. The slider 60 is coaxial with and has the same diameter as the rotor 26. The slider 60 is made of the same material as the plain bearing 31.

The rotor 26 is located in the rotor chamber 23. The rotor 26 has a rotor outer circumferential surface 28*a* and a rotor inner circumferential surface 28*b*. As shown in FIGS. 3 to 6, the rotor outer circumferential surface 28*a* extends from the rotor chamber front end surface 23*c* to the rotor chamber rear end surface 23*d*, while contacting, from inside, the rotor chamber inward surface 23*a*. The rotor inner circumferential surface 28*b* extends from the rotor chamber front end surface 23*c* to the rotor chamber rear end surface 23*d*, while contacting, from outside, the rotor chamber outward surface 23*b*. The rotor chamber 23 is therefore configured by an outer operation chamber 231, which is located outside the rotor 26, and an inner operation chamber 232, which is located inside the rotor 26.

As shown in FIGS. 1 and 2, a thrust bearing 32 is provided in the rotor driving recess 9*c* of the front plate 9 to bear the front surface of the hub 27*b*. A guide groove 11*b* is formed in the front surface of the rear plate 11 along the rotor 26. The guide groove 11*b* slidably accommodates the slider 60.

Figure 8:
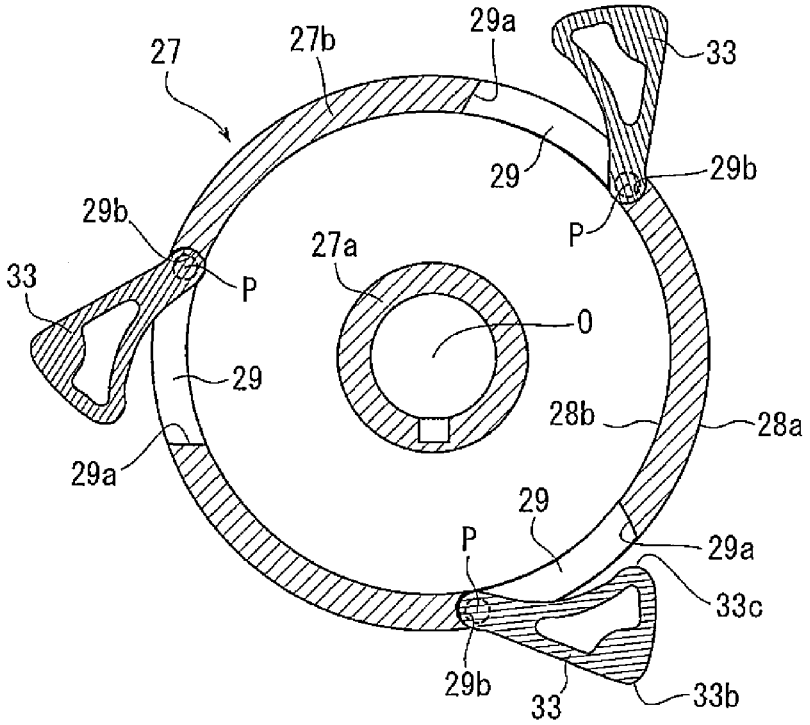
FIG. 8 is a cross-sectional view illustrating the rotor and the three cradles of the compressor according to the first embodiment.

The rotor 26 has three cradle windows 29 extending there through in the radial direction as shown in FIG. 8. Each cradle window 29 extends in parallel with the shaft axis O from the rotor chamber front end surface 23*c* to the rotor chamber rear end surface 23*d* as shown in FIGS. 1 and 2. As shown in FIG. 8, each cradle window 29 has a first end 29*a* in the circumferential direction. The first end 29*a* is shaped as a part of a cylindrical surface that has a pivot axis P, which is discussed below, as the center. The cradle window 29 further has a second end 29*b* in the circumferential direction. The second end 29*b* also is shaped as a part of the cylindrical surface that has the pivot axis P as the center.

Figure 9:
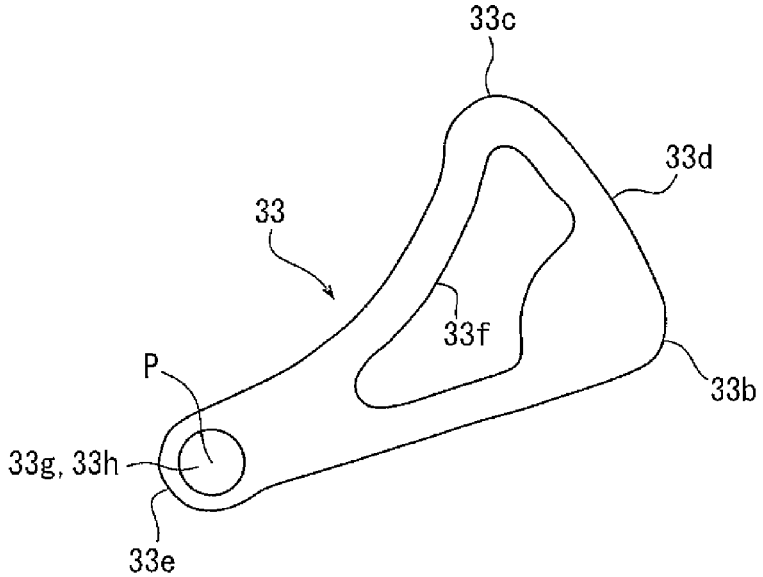
FIG. 9 is a plan view illustrating a cradle of the compressor according to the first embodiment.

A cradle 33 is provided in each cradle window 29. Each cradle 33 has a substantially triangular-pole like shape as shown in FIG. 9 and is an integral part extending from the rotor chamber front end surface 23*c* to the rotor chamber rear end surface 23*d*. Each cradle 33 has pins 33*g* and 33*h*, which protrude from the opposite ends in the axial direction. The central shaft axis of the pins 33*g*, 33*h* is a pivot axis P, which is parallel with the shaft axis O. As illustrated in FIGS. 1 and 2, the front pins 33*g* are supported by the hub 27*b*, and the rear pins 33*h* are supported by the slider 60. This allows each cradle 33 to pivot about the pivot axis P in the corresponding cradle window 29. Each cradle 33 has a hollow portion 33*f*, which extends from the rotor chamber front end surface 23*c* to the rotor chamber rear end surface 23*d* as shown in FIG. 9.

Each cradle 33 has an outer contact surface 33*b* and an inner contact surface 33*c*. The outer contact surface 33*b* is shaped as a part of a cylinder at a position outside a part separated away from the pins 33*g*, 33*h*. The inner contact surface 33*c* is shaped as a part of a cylinder at a position inside a part separated away from the pins 33*g*, 33*h*. The outer contact surfaces 33*b* contact, from inside, the rotor chamber inward surface 23*a* as shown in FIGS. 3 to 6. The inner contact surfaces 33*c* contact the rotor chamber outward surface 23*b* from outside. As shown in FIG. 9, the outer contact surface 33*b* and the inner contact surface 33*c* are connected to each other by a first sealing surface 33*d*. The first sealing surface 33*d* is a curved surface that is a part of the cylinder that conforms to the first end 29*a* of the cradle window 29. The outer contact surface 33*b* and the inner contact surface 33*c* are connected to each other by a second sealing surface 33*e*. A part of the second sealing surface 33*e* about the pins 33*g*, 33*h* is a curved surface that is a part of the cylinder that conforms to the second end 29*b* of the cradle window 29. The outer contact surface 33*b*, the inner contact surface 33*c*, the first sealing surface 33*d*, and the second sealing surface 33*e* extend from the rotor chamber front end surface 23*c* to the rotor chamber rear end surface 23*d* as shown in FIGS. 1 and 2. In this manner, the cradles 33 divide the rotor chamber 23 into operation chambers together with the rotor 26, while maintaining airtightness of the chambers. Specifically, as shown in FIGS. 3 to 6 and 7(A) to 7(D), the outer operation chamber 231 and the cradles 33 define three compression chambers 351, and the inner operation chamber 232 and the cradles 33 define another three compression chambers 352. The compression chambers 351, 352 each change in the volume as the rotor 26 rotates.

As shown in FIGS. 3 to 6, the outer block 5 has two suction ports 5*a*, which extend in parallel with the shaft axis O. In addition, the outer block 5 has two recesses in the outer circumferential surface, and each recess and the shell 3 form as a discharge port 5*b* in between. Each suction port 5*a* is connected to a compression chamber 351 in a process of volume increase. Each discharge port 5*b* is connected to a compression chamber 351 in a process of volume decrease. The inner block 7 has two suction ports 7*b* and two discharge ports 7*c*, which extend in parallel with the shaft axis O. Each suction port 7*b* is connected to a compression chamber 352 in a process of volume increase. Each discharge port 7*c* is connected to a compression chamber 352 in a process of volume decrease.

As shown in FIGS. 1 and 2, a suction chamber 37 is provided between the front housing member 1 and the front plate 9. The front plate 9 has suction passages 9*b*, 9*d*, which extend there through and communicate with the suction chamber 37. The suction passage 9*b* connects the suction chamber 37 with the suction ports 5*a*. The hub 27*b* has a suction passage 27*c*, which extends there through to connect the suction passage 9*d* with the suction ports 7*b*. The suction chamber 37 is open to the outside through a suction passage 1*b* provided in the front housing member 1.

Further, a discharge chamber 39 is provided between the shell 3 and the rear plate 11. The rear plate 11 has discharge passages 11*c*, 11*d*, which extend there through to connect the discharge ports 5*b* and the discharge port 7*c* with the discharge chamber 39. The discharge chamber 39 is open to the outside through a discharge passage 3*b* provided in the shell 3.

When the above described compressor is installed in a vehicle air conditioner, the compressor constitutes a refrigeration circuit, together with a condenser, an expansion valve, and an evaporator. The suction passage 1*b* is connected to the evaporator, and the discharge passage 3*b* is connected to the condenser. The drive shaft 19 is driven by the vehicle engine or a motor.

When the drive shaft 19 rotates about the axis O, the rotor 26 is rotated in the rotor chamber 23 by the drive shaft 19. This allows each cradle 33 to pivot about the pivot axis P in the corresponding cradle window 29 while rotating in synchronization with the rotor 26. The rotation of the drive shaft 19 causes the rotor 26 and the cradles 33 to behave as illustrated in FIGS. 3 to 6. Since the compressor has pairs of cradle windows 29 and cradles 33, compression chambers 351 are provided in the outer operation chamber 231, and compression chambers 352 are provided in the inner operation chamber 232. As the rotor 26 rotates, each cradle 33 slides on the outer block 5 and the inner block 7 at opposite pivoting ends, which extend in parallel with the shaft axis O, thereby maintaining the airtightness of the compression chambers 351, 352. Specifically, since the cradles 33 are pressed outward by the centrifugal force based on the rotation of the rotor 26, the compression chambers 351, which are provided in the outer operation chamber 231, are maintained in a highly airtight state. Thus, the compression chambers 351, 352 each change in the volume as the rotor 26 rotates. At this time, the rotor 26 rotates such that the first sealing surface 33*d* of each cradle 33 is located on the leading side. Accordingly, most of the compression reaction force of the compression chambers 351, 352 are borne by the rotor 26 via the first sealing surfaces 33*d*. This stabilizes the behavior of the cradles 33.

When increasing the volume, each compression chamber 351 draws refrigerant gas via one of the suction ports 5*a*. Likewise, when increasing the volume, each compression chamber 352 draws refrigerant gas via one of the suction ports 7*b*. When reducing the volume, each compression chamber 351 discharges refrigerant gas via one of the discharge ports 5*b*. Likewise, when reducing the volume, each compression chamber 352 discharges refrigerant gas via one of the discharge ports 7*c*. Air conditioning of the passenger compartment is thus performed.

Figure 3:
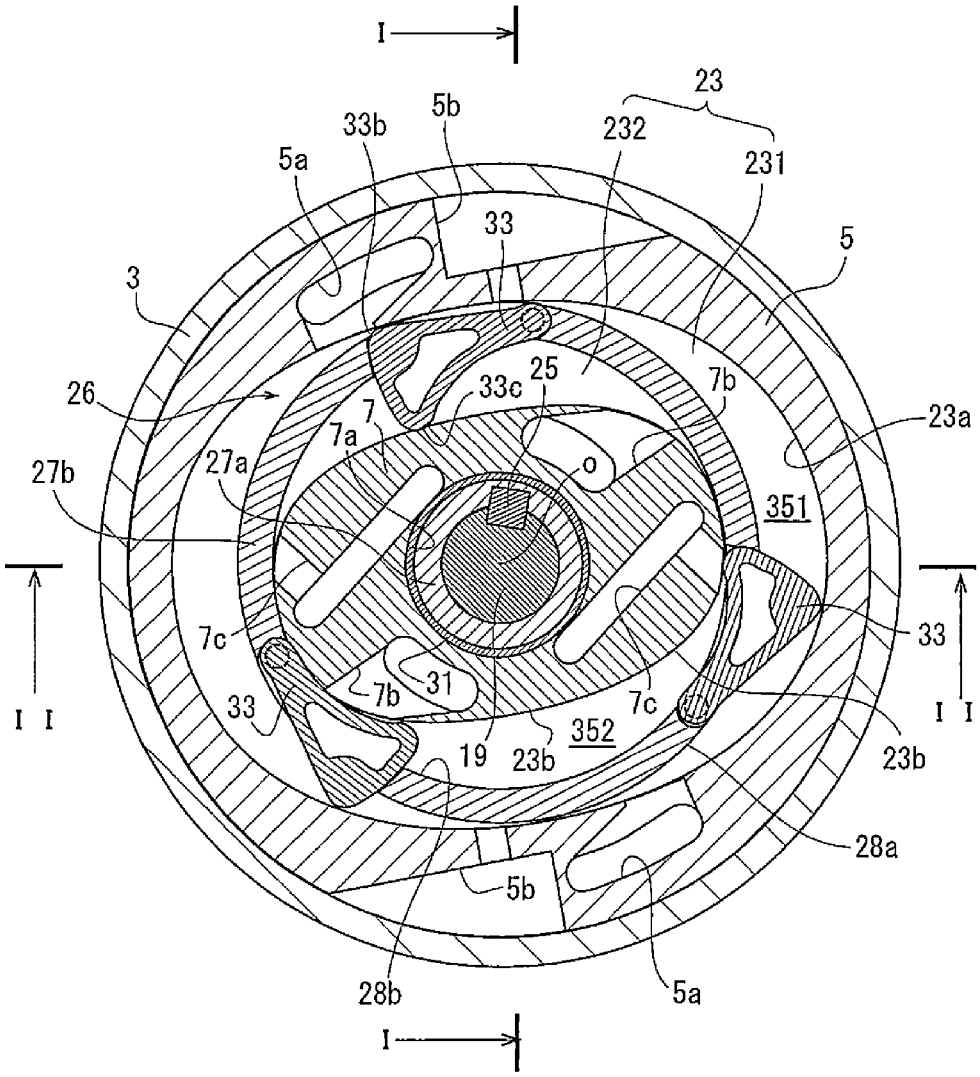
FIG. 3 is a radially cross-sectional view illustrating the compressor according to the first embodiment.
Figure 4:
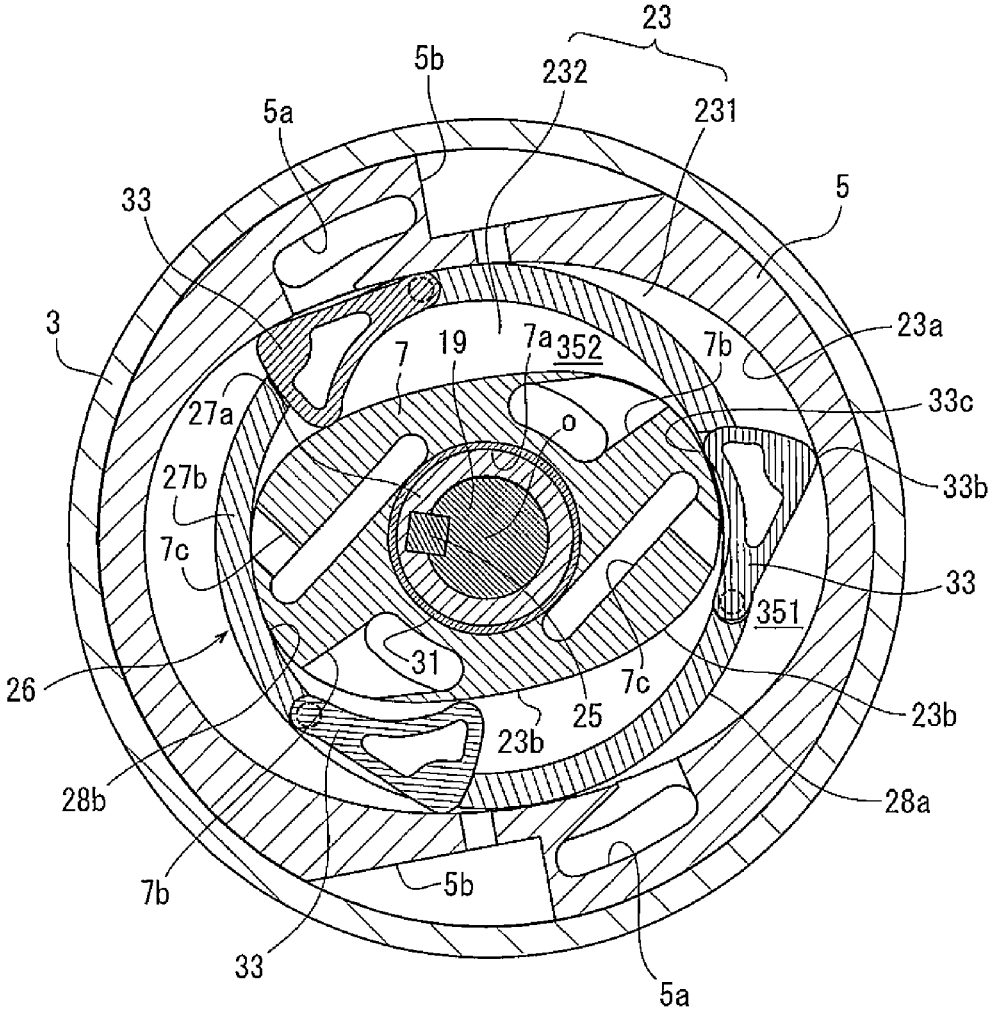
FIG. 4 is a radially cross-sectional view illustrating the compressor according to the first embodiment.
Figure 5:
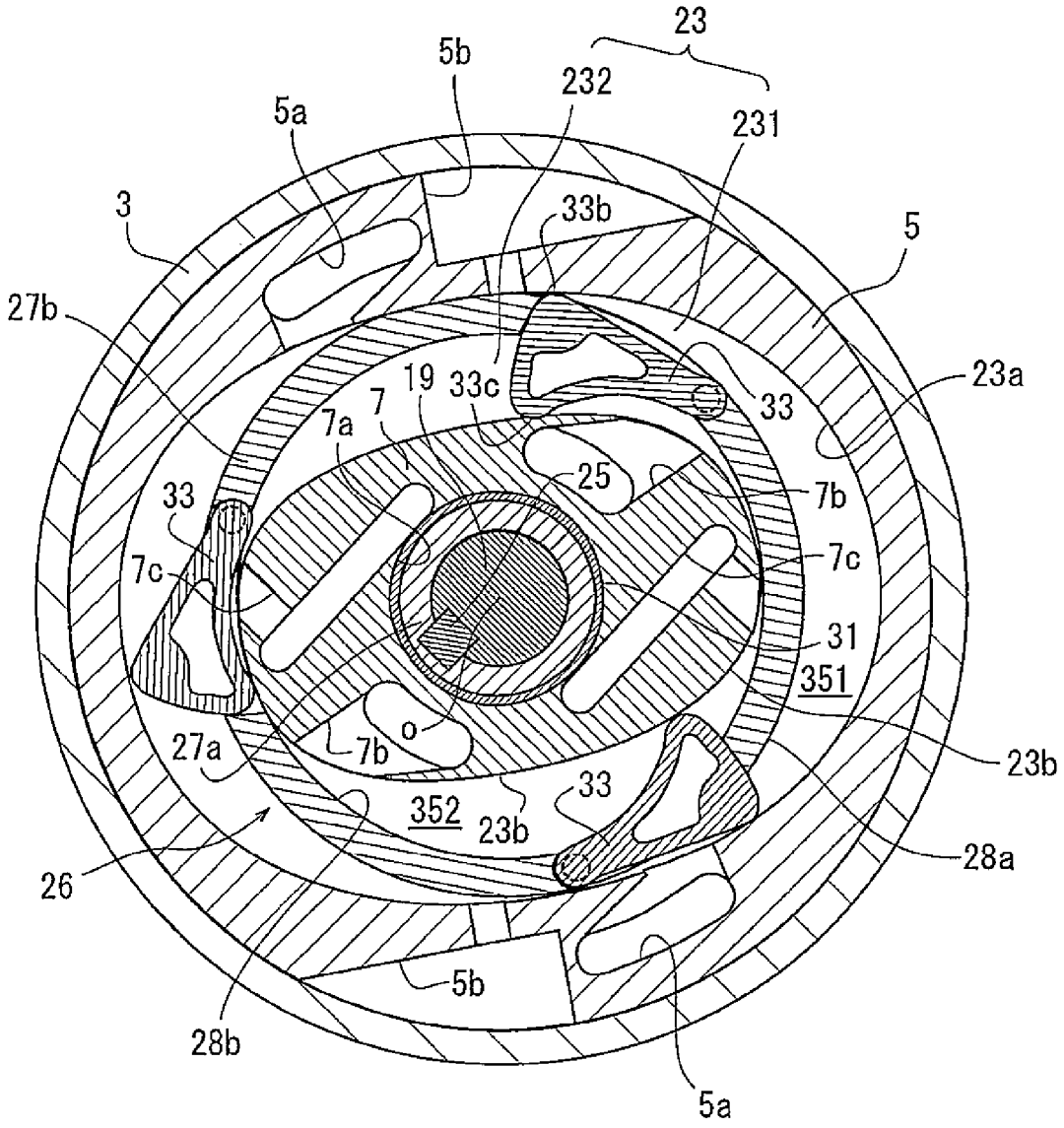
FIG. 5 is a radially cross-sectional view illustrating the compressor according to the first embodiment.
Figure 6:
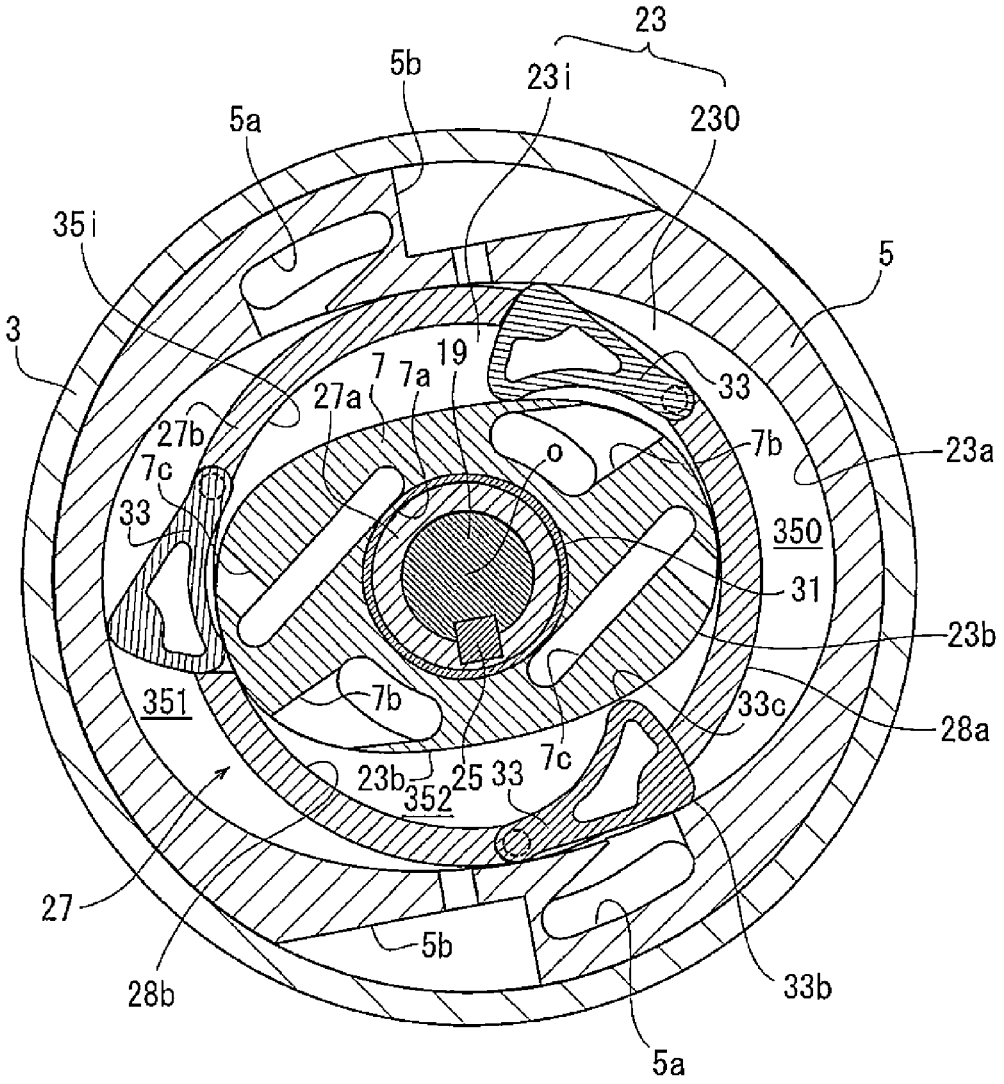
FIG. 6 is a radially cross-sectional view illustrating the compressor according to the first embodiment.
Figure 7A:
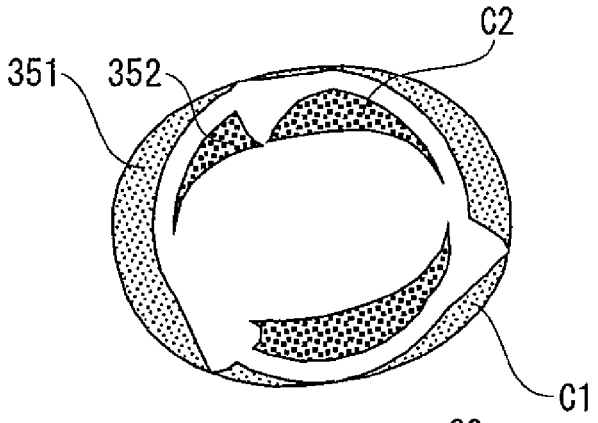
FIGS. 7(A) to 7(D) are explanatory diagrams showing changes in the compression chamber of the compressor according to the first embodiment.
Figure 7B:
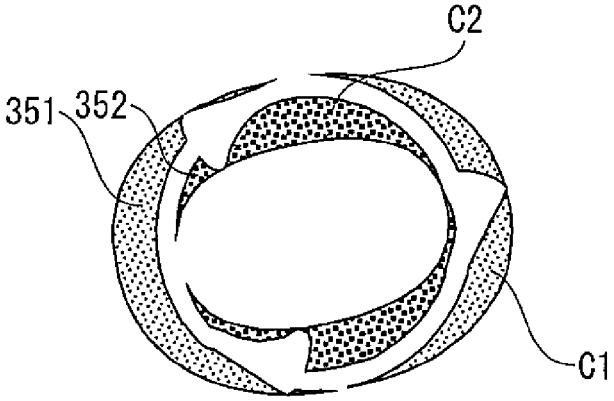
Figure 7C:
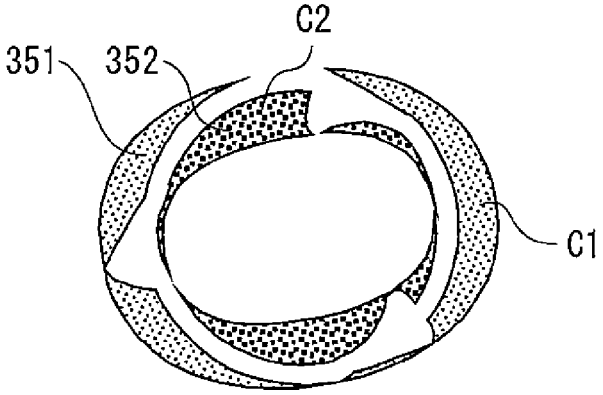
Figure 7D:
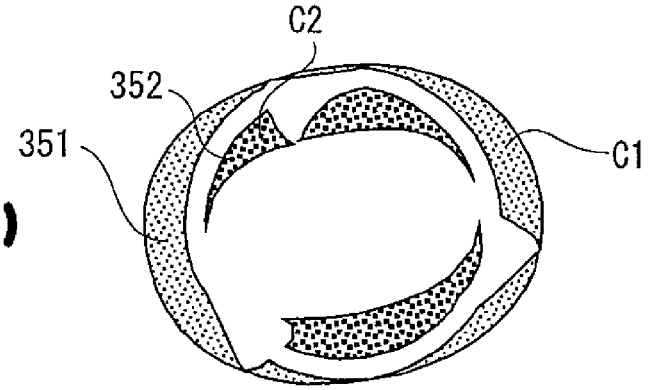

More specifically, FIG. 7(A) represents the state of the compression chambers 351, 352 of FIG. 3, FIG. 7(B) represents the state of the compression chambers 351, 352 of FIG. 4, FIG. 7(C) represents the state of the compression chambers 351, 352 of FIG. 5, and FIG. 7(D) represents the state of the compression chambers 351, 352 of FIG. 6. For example, a compression chamber C1 illustrated in FIG. 7(A), which is one of the compression chambers 351 provided in the outer operation chamber 231, is expanded in the state of FIG. 7(B) due to rotation of the drive shaft 19 and draws in refrigerant. The compression chamber C1 stops suction of refrigerant at the stage of FIG. 7(C), and the volume of the compression chamber C1 starts being reduced at the stage of FIG. 7(D). The compression chamber C1 then discharges the refrigerant. Likewise, a compression chamber C2 illustrated in FIG. 7(A), which is one of the compression chambers 352 provided in the inner operation chamber 232, is expanded in the state of FIG. 7(B) due to rotation of the drive shaft 19 and draws in refrigerant. The volume of the compression chamber C2 starts being reduced at the stage of FIG. 7(C). The compression chamber C2 then discharges the refrigerant at the stage of FIG. 7(D).

Since the volumes of the compression chambers 351, 352 are changed through rotation of the rotor 26, vibration is unlikely to be generated in the compressor. In addition, the compressor requires a relatively small number of components. Further, the cradles 33 of the compressor have a shape that is not easily broken or deformed when receiving frictional force. Particularly, since the first sealing surface 33*d* of each cradle 33 coincides with a cylindrical surface having the pivot axis P as the center, high pressure in the compression chambers 351, 352 is borne by the pivot axis P in a favorable manner. This allows the cradle 33 to pivot in a favorable manner. Additionally, having the hollow portion 33*f*, the cradles 33 are light and can easily pivot in a favorable manner. The compressor is thus beneficial in reduction of power loss. In the compressor, the rotor 26 occupies a relatively small space. In addition to the compression chambers 351 radially outside of the rotor 26, the compressor has the compression chambers 352 located radially inside of the rotor 26. This increases the displacement in relation to the volume of the entire compressor.

Further, unlike scroll compressors, the compressor of the invention requires no machining of volute grooves. Additionally, the compressor does not have parts that have low strength due to complicated shapes such as scrolls. Thus, when extended in the axial measurement to increase the displacement, the displacement can be increased simply by changing the thickness of the housing, the rotor 26, and the cradles 33. This allows the size and weight of the compressor to be easily reduced.

Further, since the compressor has sets of a cradle window 29 and a cradle 33, the power loss and pulsation are reduced. In addition, since the outer block 5 and the inner block 7 have the suction ports 5*a*, 7*b* and the discharge ports 5*b*, 7*c*, the weight of the entire compressor is reduced.

As described above, the novel positive displacement compressor solves various problems present in conventional positive displacement compressor.

Second Embodiment

Figure 10:
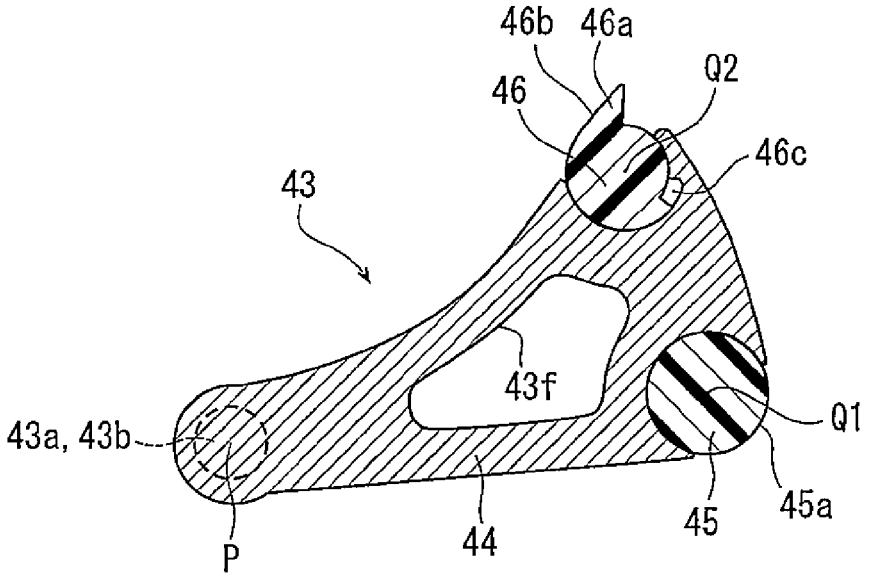
FIG. 10 is a cross-sectional view illustrating a cradle of a compressor according to a second embodiment.

A compressor according to a second embodiment of the present invention employs cradles 43 illustrated in FIG. 10. Each cradle 43 includes a cradle body 44, which has a substantially triangular-pole like shape, an outer sealing pin 45 attached to the cradle body 44, and an inner sealing pin 46 attached to the cradle body 44.

Each cradle body 44 has pins 43*a* and 43*b*, which protrude from the opposite ends in the axial direction. This allows each cradle 43 to pivot about the pivot axis P in the corresponding cradle window 29. Each cradle 43 has a hollow portion 43*f*, which extend in parallel with the shaft axis O.

The outer sealing pins 45 are made of a material different from that of the outer block 5, which defines the rotor chamber inward surface 23*a*. The outer sealing pins 45 are made of, for example, plastic. Each outer sealing pin 45 has a columnar shape extending from the rotor chamber front end surface 23*c* to the rotor chamber rear end surface 23*d*. A little more than half the outer circumferential surface of each outer sealing pin 45 is covered by the corresponding cradle body 44. The part of the outer circumferential surface that is exposed from the cradle body 44 functions as an outer contact surface 45*a*. The outer sealing pin 45 is therefore rotational about an outer rotation axis Q1, which is parallel with the shaft axis O and the pivot axis P in the cradle bodies 44. There is no limit to the rotation range of the outer sealing pin 45.

The inner sealing pins 46 are made of a material different from that of the inner block 7, which defines the rotor chamber outward surface 23*b*. The inner sealing pins 46 are made of, for example, plastic. Each inner sealing pin 46 has a columnar shape extending from the rotor chamber front end surface 23*c* to the rotor chamber rear end surface 23*d*. In addition, the inner sealing pin 46 has a lip extending radially outward in a part in the circumferential surface. Each inner sealing pin 46 also has a recess 46*c*, which is recessed inward in the radial direction in a part of the circumferential surface. While exposing the lip 46*a*, a little more than half the outer circumferential surface of each inner sealing pin 46 is covered by the corresponding cradle body 44, and the outer surface of the lip 46*a* functions as an inner contact surface 46*b*. The inner sealing pin 46 is therefore rotational about an inner rotation axis Q2, which is parallel with the shaft axis O and the pivot axis P in the cradle bodies 44. The rotation range of the inner sealing pin 46 is limited within the circumferential measurement of the recess 46*c*. Other than these differences, the second embodiment is the same as the first embodiment.

The compressor of the second embodiment achieves the same advantages as the first embodiment. In addition, the cradles 43 of the compressor are each configured by a cradle body 44, an outer sealing pin 45, and an inner sealing pin 46. The outer sealing pin 45 and the inner sealing pin 46 are separate members from the cradle bodies 44, so that an outer sealing pin 45 and an inner sealing pin 46 having optimal diameters can be selected in relation to dimensional variations in the manufacture of the cradles 43 and the housings. As a result, the outer contact surface 45*a* of each outer sealing pins 45 contact, from inside, the rotor chamber inward surface 23*a* in a favorable manner, and the inner contact surface 46*b* of each inner sealing pin 46 contact, from outside, the rotor chamber outward surface 23*b* in a favorable manner.

In addition, in the compressor, each outer sealing pin 45 rotates about the outer rotation axis Q1 relative to the corresponding cradle body 44, so that the outer contact surface 45*a* of the outer sealing pin 45 rolls on the rotor chamber inward surface 23*a* in a favorable manner. Further, since each cradle 43 presses the outer contact surface 45*a* against the rotor chamber inward surface 23*a* by the centrifugal force based on the rotation of the rotor 26, the outer contact surface 45*a* and the rotor chamber inward surface 23*a* are sealed in a favorable manner.

In contrast, each inner sealing pin 46 pivots about the inner rotation axis Q2 relative to the corresponding cradle body 44, so that the inner contact surface 45*b* of the inner sealing pin 46 rolls on the rotor chamber outward surface 23*b* in a favorable manner. In addition, each inner sealing pin 46 has a lip 46*a*, which is bent outward by the differential pressure between the compression chambers 351, 352 located on the leading and trailing sides in the rotation direction of the rotor 26. This reliably causes the lip 46*a* to contact the rotor chamber outward surface 23*b*.

Accordingly, the airtightness of the compression chambers 351, 352 is improved, which improves the compression efficiency.

Since the outer sealing pins 45 are made of a material different from that of the outer block 5, seizure between the outer contact surface 45*a* and the rotor chamber inward surface 23*a* is prevented. Likewise, since the inner sealing pins 46 are made of a material different from that of the inner block 7, seizure between the inner contact surface 46*b* and the rotor chamber outward surface 23*b* is prevented. The compressor of this embodiment thus has a high durability.

Third Embodiment

Figure 11:
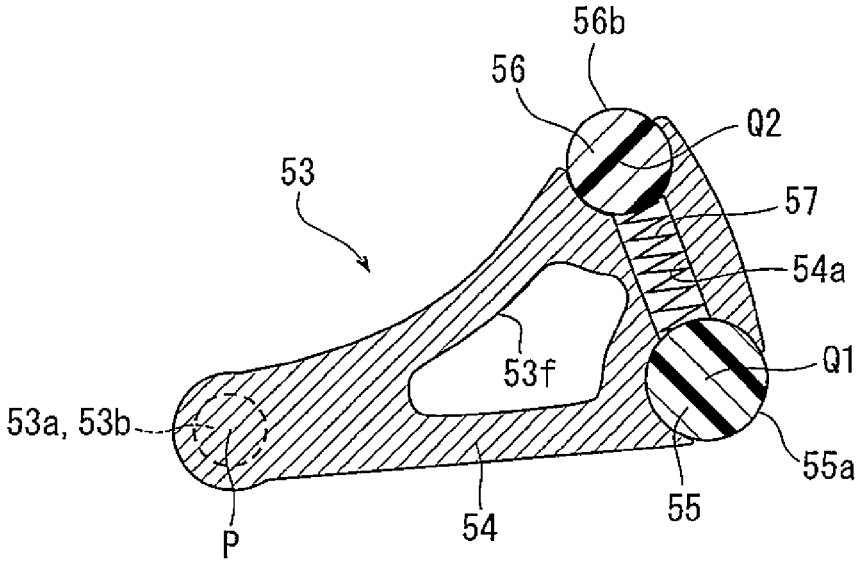
FIG. 11 is a cross-sectional view illustrating a cradle of a compressor according to a third embodiment.

A compressor according to a third embodiment employs a cradle 53 illustrated in FIG. 11. Each cradle 53 includes a cradle body 54, which substantially has a triangular-pole like shape, an outer sealing pin 55 attached to the cradle body 54, and an inner sealing pin 56 attached to the cradle body 54.

Each cradle body 54 has pins 53*a* and 53*b*, which protrude from the opposite ends in the axial direction. This allows each cradle 53 to pivot about the pivot axis P in the corresponding cradle window 29. Each cradle 53 has a hollow portion 53*f*, which extend in parallel with the shaft axis O.

The outer sealing pins 55 are made of a material different from that of the outer block 5, which defines the rotor chamber inward surface 23*a*. The outer sealing pins 45 are made of, for example, plastic. The structure of the outer sealing pin 55 is the same as that of the second embodiment.

The inner sealing pins 56 are made of a material different from that of the inner block 7, which defines the rotor chamber outward surface 23*b*. The inner sealing pins 46 are made of, for example, plastic. A little more than half the outer circumferential surface of each inner sealing pin 56 is covered by the corresponding cradle body 54, and a part of the outer circumferential surface exposed from the cradle body 54 functions as an inner contact surface 56*b*. The inner sealing pin 56 is therefore rotational about an inner rotation axis Q2, which is parallel with the shaft axis O and the pivot axis P in the cradle bodies 54. There is no limit to the rotation range of the inner sealing pin 56.

The cradle body 54 has a spring chamber 54*a*. The spring chamber 54*a* accommodates a coil spring 57, which urges the outer sealing pin 55 and the inner sealing pin 56 away from each other. Other than these differences, third embodiment is the same as the second embodiment.

The compressor of the third embodiment achieves the same advantages as the second embodiment. In addition, the outer sealing pin 55 and the inner sealing pin 56 are urged away from each other in each cradle 53, so that the outer contact surface 55*a* of the outer sealing pin 55 contact, from inside, the rotor chamber inward surface 23*a* and the inner contact surface 56*b* of the inner sealing pin 56 contacts, from outside, the rotor chamber outward surface 23*b* in a favorable manner. Accordingly, the airtightness of the compression chambers 351, 352 is improved, which improves the compression efficiency.

Although only the first to third embodiments of the present invention have been described so far, the present invention is not limited to the first to third embodiments, but may be modified as necessary without departing from the scope of the invention. Further, if a motor is used as the drive source in the present invention, the displacement per unit time can be electronically controlled.

The invention claimed is:

1. A compressor comprising:

a drive shaft that is rotational about a shaft axis;

a housing that rotationally supports the drive shaft and has a rotor chamber, wherein the rotor chamber is annular and is parallel with the shaft axis;

an annular rotor located in the rotor chamber, wherein the annular rotor has a plurality of cradle windows radially extending there through and a circumferential surface extending in a direction parallel with the shaft axis, wherein the annular rotor is rotational together with the drive shaft while sliding on the housing at the circumferential surface; and a cradle provided in each of the cradle windows and configured to pivot about a pivot axis parallel with the shaft axis, wherein each of the cradles includes an outer contact surface that continually contacts an annular rotor chamber inward surface of the rotor chamber so as to divide the rotor chamber into outer operation chambers as the rotor rotates, wherein the cradles slide on the housing at pivoting ends, which extend in directions parallel with the shaft axis, as the rotor rotates, wherein the rotor chamber includes:

the outer operation chambers located radially outside of the rotor, and inner operation chambers located radially inside of the rotor, the cradles, the outer operation chambers and the inner operation chambers form compression chambers, which change in volume by rotation of the rotor, while maintaining the airtightness, and the rotor chamber is defined by:

the annular rotor chamber inward surface, which is parallel with the shaft axis, an annular rotor chamber outward surface, which is surrounded by the annular rotor chamber inward surface and parallel with the shaft axis, a rotor chamber front end surface, which is perpendicular to the shaft axis, and a rotor chamber rea rend surface, which is perpendicular to the shaft axis, the rotor includes:

a rotor outer circumferential surface, which extends from the rotor chamber front end surface to the rotor chamber rear end surface, while contacting, from inside, the rotor chamber inward surface, and a rotor inner circumferential surface, which extends from the rotor chamber front end surface to the rotor chamber rear end surface, while contacting, from outside, the rotor chamber Outward surface, and the cradles include:

the outer contact surface, which contacts, from inside, the rotor chamber inward surface in a range from the rotor chamber front end surface to the rotor chamber rear end surface, an inner contacting surface winch contacts, from outside, the rotor chamber outward surface in a range from the rotor chamber front end surface to the rotor chamber rear end surface, a first sealing surface, which connects the outer contact surface and the inner contact surface to each other and seals a first end in the circumferential direction of the cradle window, and a second sealing surface, which connects the outer contact surface and the inner contact surface to each other and seals a second end in the circumferential direction of the cradle window, wherein the housing includes:

an outer block that forms the rotor chamber inward surface, an inner block, which is arranged inside the outer block and forms the rotor chamber outward surface and wherein the inner block includes a suction port and a discharge port, which communicate with the compression chambers.

2. The compressor according to claim 1, wherein one of the first sealing surface and the second sealing surface is closer to the pivot axis than the other one of the first sealing surface and the second sealing surface.

3. The compressor according to claim 2, wherein the other one of the first sealing surface and the second sealing surface that is farther from the pivot axis is shaped as a part of a cylindrical surface that has the pivot axis as the center.

4. The compressor according to claim 2, wherein the one of the first sealing surface and the second sealing surface that is closer to the pivot axis is shaped as a part of a cylindrical surface that has the pivot axis as the center.

5. The compressor according to claim 1, wherein the housing further includes a front plate, which is fixed to the outer block and to the inner block, and forms the rotor chamber front end surface, and a rear plate, which is fixed to the outer block and to the inner block, and forms the rotor chamber rear end surface.

6. The compressor according to claim 5, wherein the housing includes a shell, which accommodates the outer block, the inner block, the front plate, and the rear plate, and a front housing member, which is fixed to the shell and rotationally supports the drive shaft.

7. The compressor according to claim 1, wherein the rotor and the drive shaft are coupled to each other by a hub, which is perpendicular to the shaft axis, and the hub functions as a part of the rotor chamber front end surface or the rotor chamber rear end surface.

8. The compressor according to claim 1, wherein the cradles include:

a cradle body, which is arranged in the cradle window to be allowed to pivot, an outer sealing pin, which is provided in the cradle body and has the outer contact surface, and an inner sealing pin, which is provided in the cradle body and has the inner contact surface.

9. The compressor according to claim 8, wherein the outer sealing pin is provided in the cradle body to be rotational about an outer rotation axis, which is parallel with the shaft axis and the pivot axis.

10. The compressor according to claim 8, wherein the inner sealing pin is provided in the cradle body to be rotational about an inner rotation axis, which is parallel with the shaft axis and the pivot axis.

11. The compressor according to claim 8, wherein at least one of the outer sealing pin and the inner sealing pin has a lip, which is pushed by a pressure difference between a leading side and a trailing side in the rotation direction of the rotor and is caused to contact the rotor chamber inward surface or the rotor chamber outward surface.

12. The compressor according to claim 8, wherein the cradles have a coil spring, which urges the outer sealing pin and the inner sealing pin away from each other.

13. The compressor according to claim 1, wherein the outer contact surface is made of a material that is different from a material that defines the rotor chamber inward surface.

14. The compressor according to claim 1, wherein the inner contact surface is made of a material that is different from a material that defines the rotor chamber outward surface.

15. The compressor according to claim 1, wherein the cradles are hollow.

16. The compressor according to claim 1, wherein each of the cradles is configured so that the first sealing surface is a leading end of the cradle during rotation of the rotor.

* * * * *